US012502571B2

(12) United States Patent
Allen et al.

(10) Patent No.: US 12,502,571 B2
(45) Date of Patent: Dec. 23, 2025

(54) SOFT, SILENT WEIGHTLIFTING PLATES

(71) Applicants: Laura Allen, Portland, OR (US); Scott Donnell, Portland, OR (US)

(72) Inventors: Laura Allen, Portland, OR (US); Scott Donnell, Portland, OR (US)

( * ) Notice: Subject to any disclaimer, the term of this patent is extended or adjusted under 35 U.S.C. 154(b) by 133 days.

(21) Appl. No.: 18/170,485

(22) Filed: Feb. 16, 2023

(65) Prior Publication Data

US 2023/0256287 A1 Aug. 17, 2023

Related U.S. Application Data

(60) Provisional application No. 63/310,939, filed on Feb. 16, 2022.

(51) Int. Cl.
*A63B 21/06* (2006.01)

(52) U.S. Cl.
CPC ..... *A63B 21/06* (2013.01)

(58) Field of Classification Search
CPC ... A63B 21/06; A63B 21/072; A63B 21/4035; A63B 21/0603
See application file for complete search history.

(56) References Cited

U.S. PATENT DOCUMENTS

| | | | | |
|---|---|---|---|---|
| 5,284,343 | A * | 2/1994 | Bigornia | A63B 21/0605 473/588 |
| 6,216,926 | B1 * | 4/2001 | Pratt | A45F 3/04 224/655 |
| 9,907,990 | B2 * | 3/2018 | Januszek | A63B 21/00065 |
| 10,343,009 | B2 * | 7/2019 | Peyton | A63B 21/072 |
| 10,561,885 | B1 * | 2/2020 | Lewis, Jr. | A63B 21/0603 |
| D1,004,720 | S * | 11/2023 | Gray | D21/680 |
| 2014/0309089 | A1 * | 10/2014 | Buikema | A63B 21/0004 482/105 |
| 2016/0129292 | A1 * | 5/2016 | Stroup | A63B 23/12 434/247 |
| 2017/0304671 | A1 * | 10/2017 | Hill | A63B 21/0726 |
| 2019/0269956 | A1 * | 9/2019 | Henniger | A63B 21/0603 |
| 2020/0215375 | A1 * | 7/2020 | Fujii | A63B 21/072 |
| 2022/0032109 | A1 * | 2/2022 | Henniger | A63B 21/0603 |
| 2024/0278061 | A1 * | 8/2024 | Bassoo | A63B 21/4007 |

* cited by examiner

*Primary Examiner* — Andrew M Kobylarz
(74) *Attorney, Agent, or Firm* — Mark S Hubert PC

(57) ABSTRACT

A soft, silent barbell or dumbbell plate designed for low cost fabrication, shipping and sales. It incorporates a leak proof seal to ensure the sand, steel shot or other filler will not come out of the plate during use. It is adjustable in weight and with its durable outer shell, will not mark or chip floors. Since the plate's outer surface is flexible and the general geometric circular plate configuration may deform slightly, the plate is substantially silent in use and when contacting similar plates and the floor.

10 Claims, 10 Drawing Sheets

SOFT, SILENT WEIGHTLIFTING PLATES

CROSS-REFERENCE TO RELATED APPLICATIONS

THIS APPLICATION CLAIMS THE BENEFIT OF U.S. PROVISIONAL PATENT APPLICATION NO. 63/310,939, FILED Feb. 16, 2022, WHICH IS INCORPORATED BY REFERENCE HEREIN IN ITS ENTIRETY.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to exercise equipment, and more particularly to weightlifting plates for use with barbells and dumbbells.

BACKGROUND

Weightlifting as a form of exercise is generally done in a commercial gym or in a private garage/basement. The reason being, is that conventional weight plates are generally made of a cast steel, so that when aggressively set onto the floor, or when dropped, they make a loud noise and dent, chip or compress the floor material.

The weightlifting plates are loud when bumped against each other, often throwing metal flakes, which are an eye hazard when the weights are above the lifter's head. They pick up moisture from humid gyms and develop unsightly surface rust that discolors human hands and clothes as well as everything they contact. As the price of raw steel rises so do the prices of the weight plates. Metal is just too expensive to be used as a dense filler mass anymore.

Improvements have been made wherein most modern weight plates have a thin polymer coating to eliminate rusting and deaden the ringing that occurs in weight plate collisions. This however, tends to make the weight plates slippery to pick up since all the edges are generally rounded or chamfered, and increases the cost. Despite some improvements, these can crack in colder temperatures, especially when rigorously contacting the floor.

When the weight sets have to be moved or stored, they are heavy, do not stack safely without costly weight trees, and take up space. Because of their considerable density and weight, purchasing weight plates (from a store or online) bears the high cost of transportation to the end user. Because of their traditional format has been steel, polymer coated steel or plastic coated cement, when the contact the floor the will dent wood floors and chip concrete floors. Lastly, unattended weights in barbell or dumbbell configurations, will roll about on uneven floors, potentially damaging walls and baseboards.

Henceforth, new weightlifting plates that would be economical to manufacture, ship and sell, quiet, not roll on a sloped floor, not throw metal flakes, not rust, not be slippery, not damage walls floors or baseboards, and could be easily moved and vertically stacked and stored, would eliminate all the aforementioned problems and fulfill a long felt need in exercise industry. This new invention utilizes and combines known and new technologies in a unique and novel configuration to overcome the aforementioned problems and accomplish this.

BRIEF SUMMARY

In accordance with various embodiments, a soft, silent weightlifting plate is provided.

In one aspect, a weightlifting plate is provided that is soft, adjustable in weight, will fit in with conventional weightlifting equipment (bars), will not damage or mar floors, will not roll, can be transported very economically without the full weight of the useable plate, with not rust or throw metal flakes off, be silent, not be slippery when wet and can be moved with handles, compress slightly when contacted to prevent bruising upon contact with a weightlifter, and can be vertically stacked on each other.

In another aspect, a weightlifting plate is provided that is adjustable in weight and is designed for use with or without a bar. It may be used as a weightlifting plate, as an alternative for a kettlebell, or as a two handed body weight for situps, twists, presses, curls, extensions and similar exercises.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

DETAILED DESCRIPTION OF CERTAIN EMBODIMENTS

Figure 1:
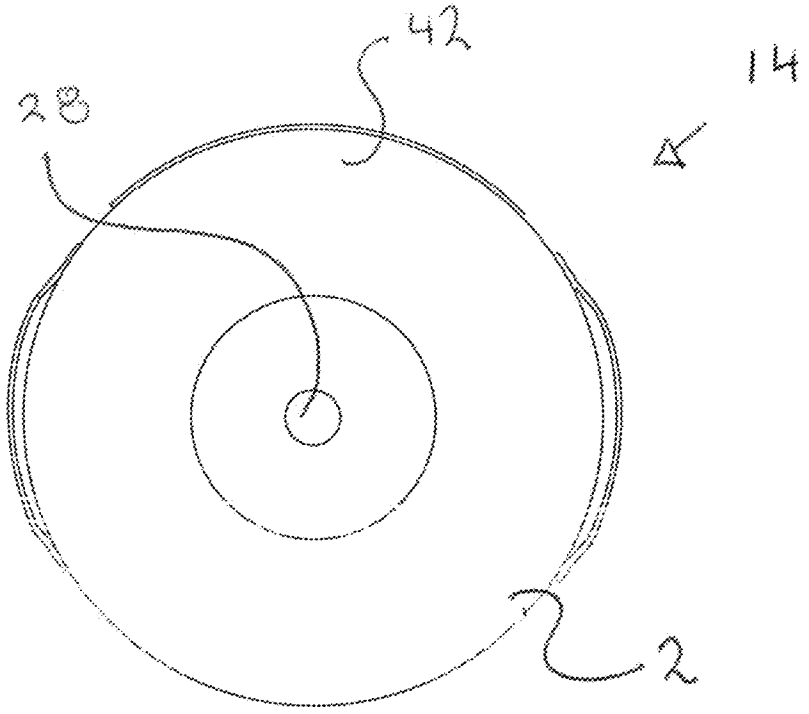
FIG. 1 is a side view of the weightlifting plate.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

Reference will now be made in detail to embodiments of the inventive concept, examples of which are illustrated in the accompanying drawings. The accompanying drawings are not necessarily drawn to scale. In the following detailed description, numerous specific details are set forth to enable a thorough understanding of the inventive concept. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first bag could be termed a second bag, and, similarly, a second bag could be termed a first bag, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

The terminology used in the description of the inventive concept herein is for the purpose of describing particular embodiments only and is not intended to be limiting of the inventive concept. As used in the description of the inventive concept and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "inner seal" refers to the innermost seal of either embodiment of the inner segment bag.

As used herein the term "outer seal" refers to the exterior seal of either embodiment inner segment bag.

As used herein the term "intermediary seal" refers to the middle seal of the second embodiment inner segment bag.

As used herein, the term "plate" refers to the assembled weightlifting plate of the present invention.

As used herein to describe the shape of the inner segment bags, "generally triangular" means a pie shaped wedge that has a truncated frustum.

Figure 10:
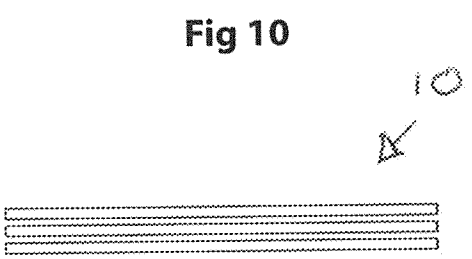
FIG. 10 is a top view of the weight indicating strips.
Figure 12:
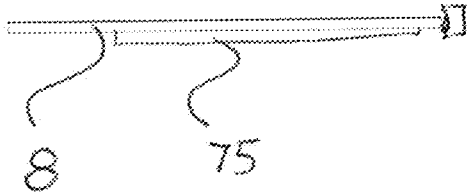
FIG. 12 is a side view of a bar collar tie.

The present invention relates to a novel design for an economical weightlifting plate 14 (FIGS. 1 and 2) that is non-steel, cheap to transport, non-damaging, silent, does not roll around and aesthetically pleasing. It has five components: an outer housing bag 2 (FIG. 1), a set of generally triangular inner segment bags 4 (FIG. 4), a bar collar 6 (FIG. 6), a bar collar tie 8 (FIG. 12) and an optional set of colored strips 10 (FIG. 10). A dense filler material preferably paver sand, (not illustrated) is incorporated into the inner segment bags 4 by the end user when these five components are assembled on site prior to us.

Figure 2:
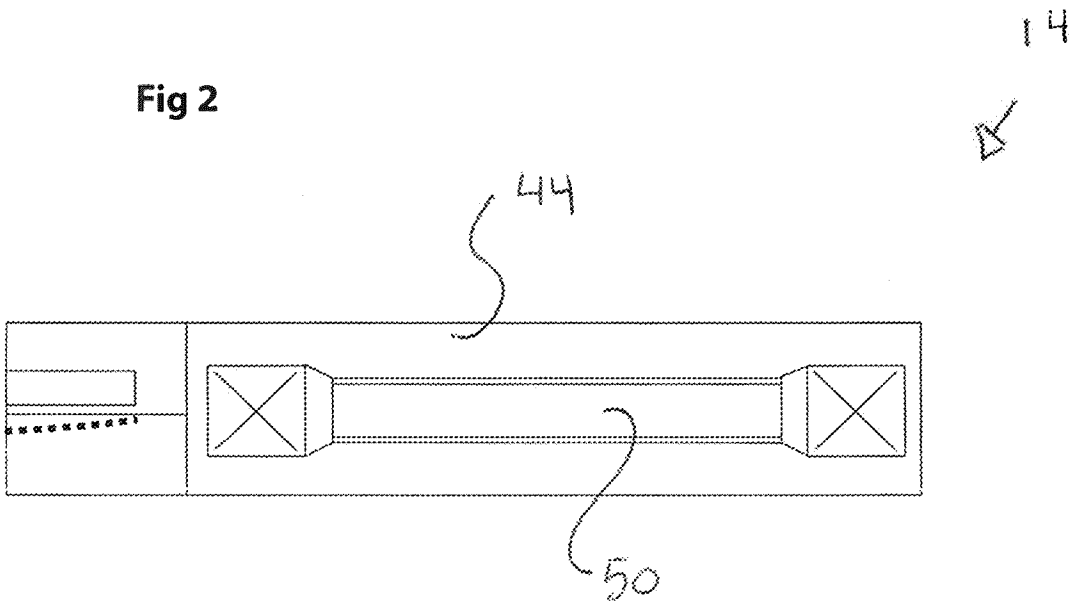
FIG. 2 is a side view of the outer cover in the region of the handle and zipper.
Figure 3:
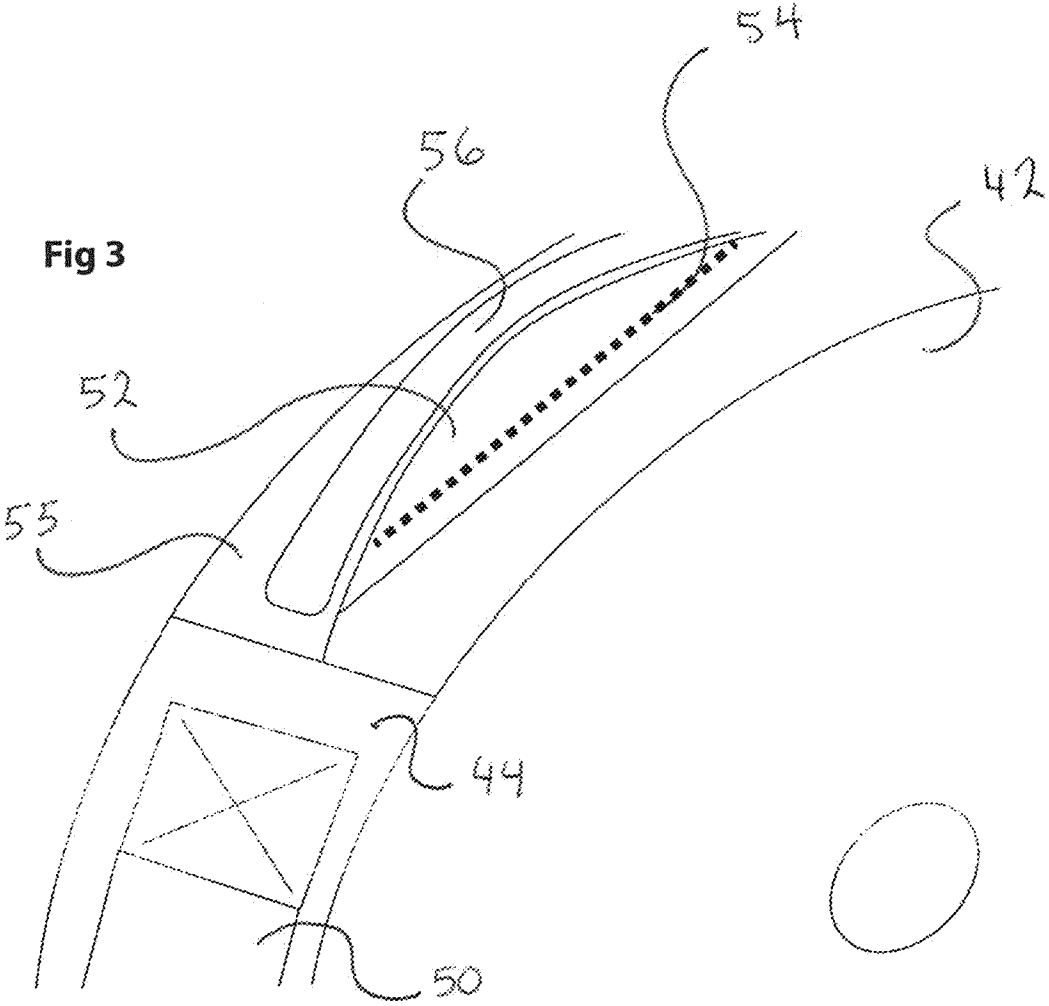
FIG. 3 is partial side perspective view of the outer cover clearly showing the loop portion strip used to secure the hook portion strip of the weight coding strips.
Figure 5:
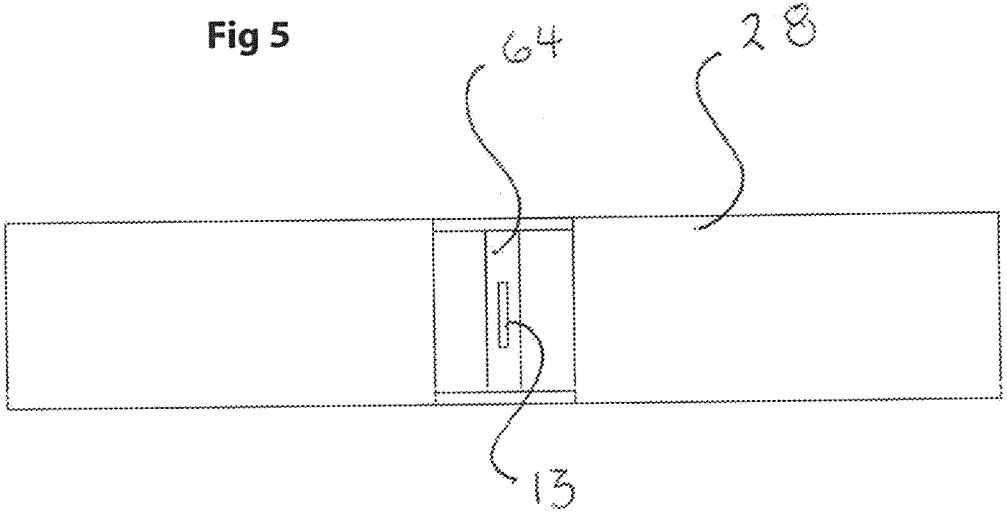
FIG. 5 is a top inner view of the barbell support inserted into the inner sleeve of the outer bag.

Looking at FIGS. 1-3 the outer bag 2 can best be described. It is an openable ring fabricated from a tough, thick denier polymer fabric. It has a two planar side panels 42 held in a generally planar, spaced configuration by a circular perimeter edge panel 44. There is a collar tunnel 28 extending across the inner cavity of the outer bag 2 that is located centrally between the two side panels 42. (FIG. 5) There is a toroidal inner cavity formed therein said outer bag. The cylindrical collar tunnel 28 has a slit 64 formed therethrough to allow the passage of the securement tab 13. There is at least one fabric handle 50, but preferably two (FIGS. 1-3) sewn onto the edge panel 44 and an outer zipper 54 also sewn onto a linear opening 52 in the edge panel 44. Adjacent to the zipper 54 is a cover flap 55 that has its inner face residing over the outer zipper 54 to protect the zipper 54 as well as to protect the user from abrasions if the edge panel 44 of the plate 14 is contacted. On the top face of the cover flap 55 is one half of a hook and loop fastener strip 56.

Figure 7:
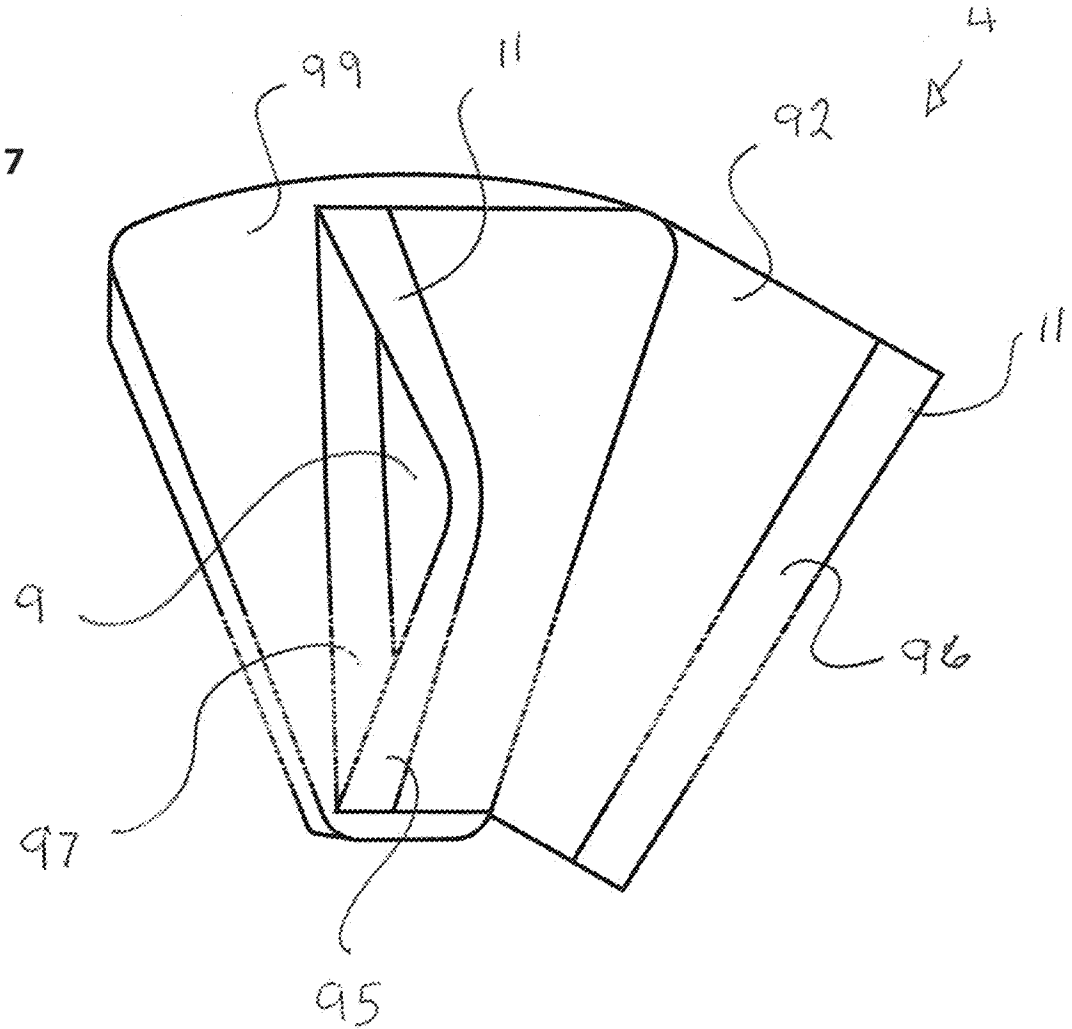
FIG. 7 is a top view of the first embodiment inner segment bag showing the inner (primary) and outer (secondary) seals opened.
Figure 8:
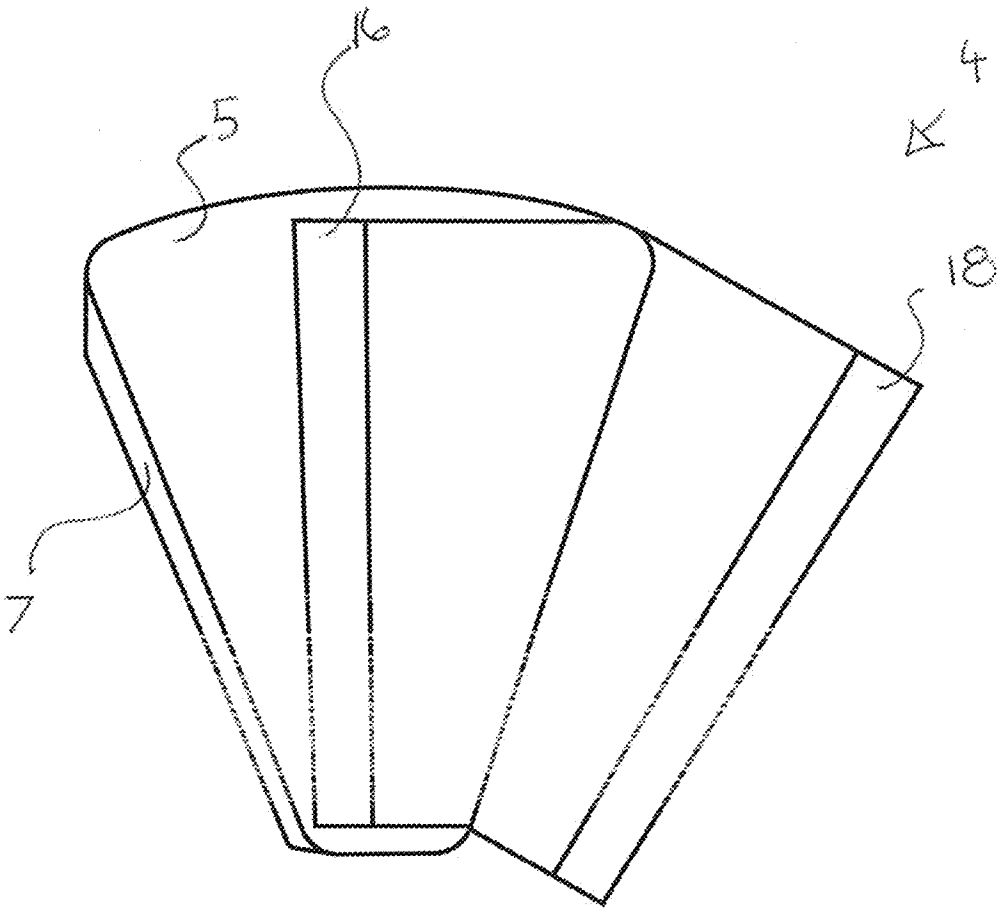
FIG. 8 is a is a top view of the first embodiment inner segment bag showing the inner seal closed and the outer seal opened.
Figure 9:
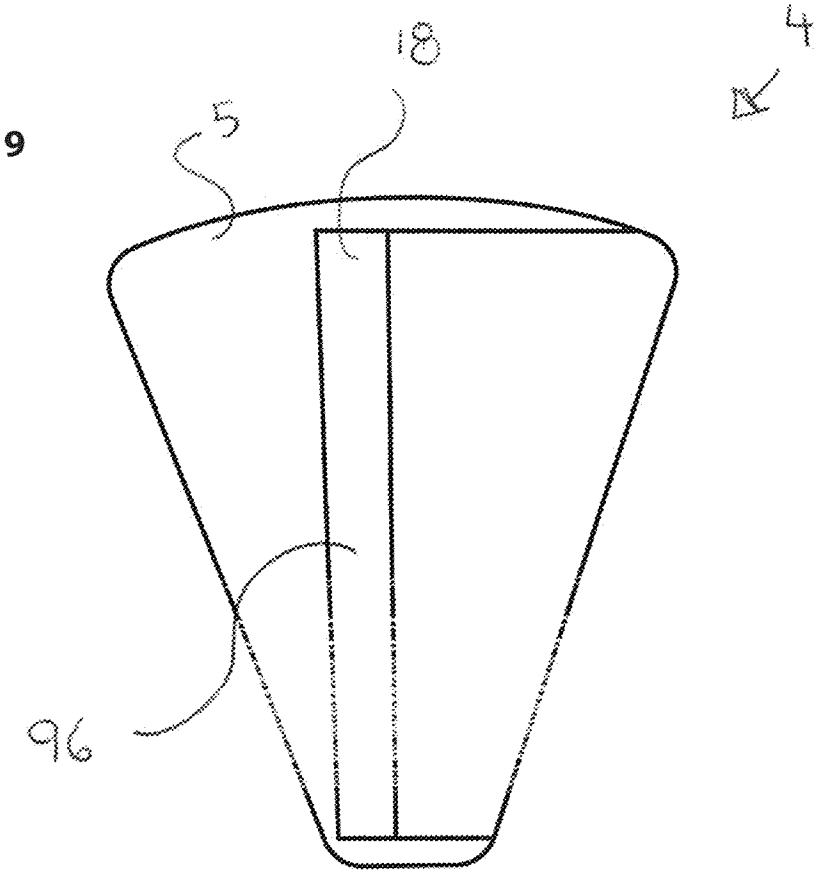
FIG. 9 is a is a top view of the first embodiment inner segment bag showing the inner and outer seals closed.

The outer bag 2 is filled with a series of inner segment bags 4. Looking at FIGS. 7-9 it can be seen that the inner segment bags 4 are a set of pie shaped (generally triangular) bags having two planar pie shaped panels 5 held in a generally parallel spaced configuration by an edge strip 7. (FIG. 8) The pie shaped panels 5 are generally triangular and have a truncated frustum shape. The bags are dimensionally sized and their sides angled so that when all of the inner segment bag's sides abut adjacent inner segment bag's sides, the entire assembly forms a circular ring the approximate size of the outer bag 2.

Each inner segment bag 4 has an inner seal 16 and an outer seal 18 that reside centrally located along a slit 9 running the partial length of one of their planar top faces 99. The inner seals 16 are accomplished with lower and first upper meshingly engageable hook and loop fastener strips placed along the edges of the slit 9 in an overlaying fashion such that when meshingly engaged, the slit is sealed. The lower fastener strip 97 is approximately twice the width of the first upper fastener strip 95. The outer seals 18 are also accomplished using a second upper meshingly engageable hook and loop fastener strip 96 that is one half the width of the lower fastener strip 97, and substantially identical to the first upper fastener strip 95. This second upper fastener strip 96 is placed along the edge of the outer flap 92 that overlays the slit 9. The second upper fastener strip 96 engages the lower fastener strip 97 adjacent to where the first upper fastener strip 95 engages the lower fastener strip 97. This ensures a double seal against the escape of any filler material. The first upper fastener strip 95 is not visible when the inner segment bag 4 is fully closed and sealed.

Figure 6:
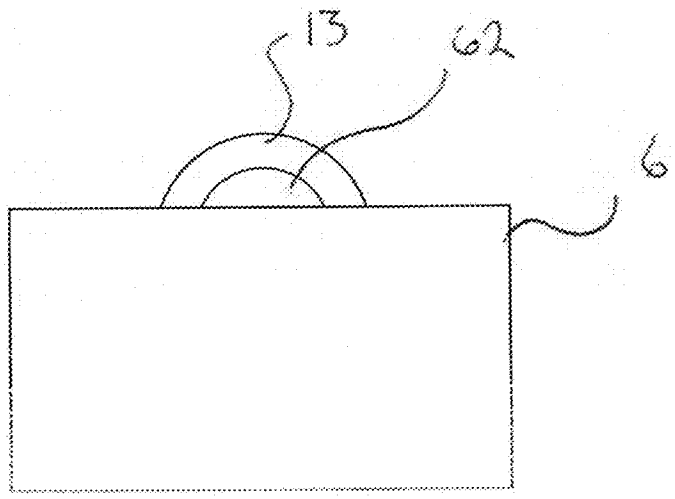
FIG. 6 is a side view of the collar.

Looking at FIG. 6, the bar collar 6 can best be seen. It is a rigid cylinder preferably made of steel or metal, with a thin planar crescent shaped securement tab 13 extending normally therefrom, parallel with the linear axis of the bar collar 6. In an alternate embodiment, (not illustrated) the distal end and proximal end of the bar collar 6 may be flared outward to allow easy entrance of a bar into the assembled plate 14 (FIG. 1). When placed into the collar tunnel 26 the collar 6 is rotated until its securement tab 13 extends into the inner cavity of the outer bag 2. A bar collar tie 8 (FIG. 12) is fed through the opening 62 in the securement tab 13 and wrapped and fastened around the collar tunnel 26 so as to ensure the bar collar 6 cannot slide outside the collar tunnel 26 and leave the plate 14 or extend beyond its. The bar collar tie 8 in the preferred embodiment is but a simple non-reusable polymer zip tie, however, other equivalent ties are envisioned for use that are made of rope, cable, elastic strips, hook and loop strips and the like.

Looking at FIG. 1, the color strips 10 can best be seen. These are colored fabric strips with half of a hook and loop fastener strip 75 affixed along their length. The strip's length and width is complimentary to the width and length of the half hook and loop fastener strip 56 that resides on the top of the cover flap 55. In the preferred embodiment there are several different colors that correspond to the weight of the plate 14 with different combinations of filled inner segment bags 4. In the preferred embodiment these are blue, green and yellow for 45, 35 and 25 pound increments.

The assembly of the weightlifting plate 14 is simple. It is shipped with all of the elements (except the dense filler material 10) compressed and placed within the closed outer bag 4. The bar collar 6 is removed from the bag 2 and inserted into the central collar tunnel 28 formed at the center of the outer bag 2, between its two planar sides such that its tab 13 passes through the slot 32 in the central tunnel 26. With the tab 30 facing inward, a bar collar tie 8 is placed around the inside perimeter of the tunnel 28, passing through the opening 62 under the securement tab 13, and locked into place to prevent the collar 6 from sliding out of the tunnel 28.

Upon removal of the inner segment bags 4, the outer seal and inner seals are opened. A premeasured amount of dense filler material (preferably a paver sand commonly available at any building material supply store) is added into at least some of the bags depending on the desired overall weight of the plate 14. Generally, for an overall plate weight of 45 pounds, 5 level cups of paver sand 12 will be inserted into each of the nine inner segment bags 4. If a lesser weight is desired, rather than filling the inner segment bags 4 partially full, some of these bags 4 are filled with a lightweight filler material (preferably foam packing peanuts or foam beads) and the remainder of the inner segment bags 4 are filled with the heavy paver sand 10.

Figure 4:
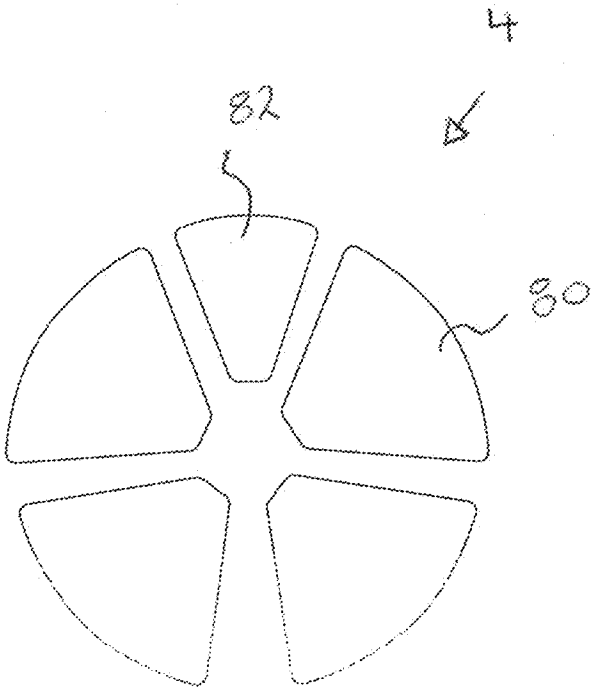
FIG. 4 is a top view of the inner bags (first and second embodiments), arranged as they would be within the cover.

Now filled, the inner segment bags 4 have their inner seal 16 closed, then their outer seal 18 closed. In the preferred embodiment, these seals are hook and loop fastener strips that are affixed onto the edges of the transverse slit 9 along the length of the inner segment bags 4 (the inner seal) and are affixed onto the edge of the flap 92 that overlaps the slit 9, (the outer seal). The two complementary halves 24 of these hook and loop fasteners reside side by side on the bottom edge of the slit 20. This redundant sealing system ensures that with all of the jarring of the plate 14 in use, no filler material will escape into the outer bag 2. These inner segment bags 4 are arranged into the outer bag 2 with their truncated side in contact with the bar collar 6. The inner segment bags 4 are placed adjacent to the other inner segment bags 4 (alternating between those filled with dense material and those filled with lightweight material) to form a ring as illustrated in FIG. 4. The outer zipper 54 of the outer bag 2 is closed forming an outer third seal, and then optionally, a colored strip designating the total weight is affixed to one half of a hook and loop fastener that is sewn about the partial periphery of the side of the plate 14. The plate 14 is now ready to be slid onto a weightlifting bar or it may used holding one or both of the side handles, similar to the common kettlebell exercises.

Figure 11:
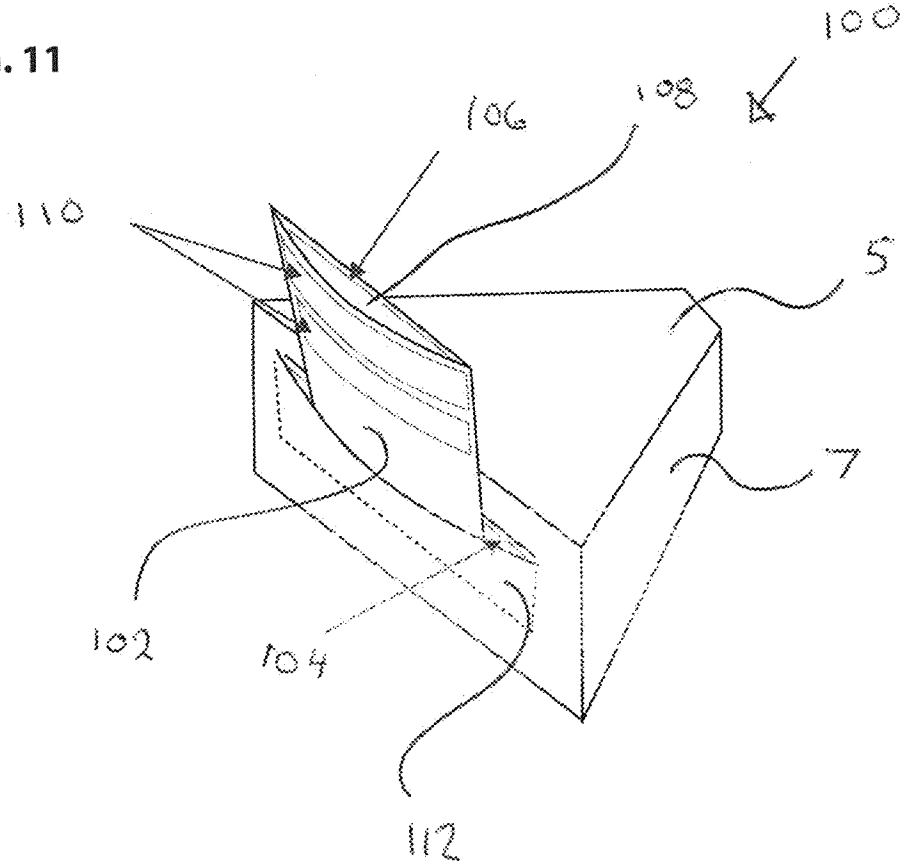
FIG. 11 is a top perspective view of the second embodiment inner segment bag.

Looking at FIG. 11, the structure and function of the second embodiment inner segment bags 100 can best be explained. These inner segment bags 100 are also a set of pie shaped (generally triangular) bags having two planar pie shaped panels 5 held in a generally parallel spaced configuration by an edge strip 7. (FIG. 8) The pie shaped panels 5 have a truncated frustum shape. The bags are dimensionally sized and their sides angled so that when all of the inner segment bag's sides abut adjacent inner segment bag's sides, the entire assembly forms a circular ring the approximate size of the outer bag 2. This inner segment bag 100 differs from the first embodiment inner segment bag 4 in that it has and inner media sleeve 102, fills from a slit 104 in the edge strip 7, and has three seals rather than two seals to contain the media. This inner media sleeve 102 extends out a slit 104 formed in the edge strip 7 and has an openable top end 106 with a first pair of opposing hook and loop fastener strips 108 located just inside the top edge of the top end 106 (inner seal). On the outer face of the sleeve is a second pair of hook and loop fastener strips 110 that reside adjacent each other. This second pair of hook and loop fastener strips 110 are engaged by folding the sleeve 102 between them to form an intermediary seal. With the sleeve 102 loaded with media, these two seals are made and the exposed portion of the sleeve 102 is tucked into the inner segment bag 100. There is a third pair of hook and loop fastener strips 112 (shown in phantom lines) affixed to the edges of the slit 104 made in the edge strip 7 that is used to form a third seal once the double sealed sleeve 102 is inserted into the inner segment bag 100.

The second embodiment plate uses all the components of the first embodiment plate 14 except it substitutes the second embodiment inner segment bag 100 for the first embodiment inner segment bag 4. In use, the sleeve 102 is filled with media, the first seal is made, the top of the sleeve 108 is folded over, the second seal is made, the sleeve is inserted into the inner segment bag 100 through the edge strip's slit 104 and the third seal on the edge strip's slit is closed. From this point on, the assembly of the second embodiment plate is the same as the first embodiment plate.

It is to be noted that in the preferred embodiments, the number of inner segment bags is five. These are based on nine equal volume segments of the circular plate's volume, eight of which are made into double volume inner segment bags. These five inner segment bag sizes were chosen as they allow for the adjustability of the plate's weight using combinations of standard paver sand or packing peanuts that most closely resemble the common weights used by athletes.

While certain features and aspects have been described with respect to exemplary embodiments, one skilled in the art will recognize that numerous modifications are possible. The plate 14 is an integrated system that is adjustable in weight and uses a triple, or quadruple seal to prevent the leakage of filler material.

Having thus described the invention, what is claimed as new and desired to be secured by Letters Patent is as follows:

1. A weightlifting plate, comprising:

a circular, fabric outer housing bag comprising a pair of opposing fabric panels joined at their centers by a fabric collar tunnel and joined along their peripheral edges by a circular fabric edge panel, said circular fabric edge outer housing bag forming a toroidal shaped inner cavity;

a set of generally triangular fabric inner segment bags adjacently arrangeable to fill said toroidal shaped inner cavity;

a rigid cylindrical bar collar residing within said fabric collar tunnel between said opposing panels; and a bar collar tie affixing said rigid cylindrical bar collar to said fabric collar tunnel.

2. The weightlifting plate of claim 1, further comprising:

at least one seal to close each one of said triangular fabric inner segment bag to prevent media installed into said inner segment bag from escaping.

3. The weightlifting plate of claim 2, wherein said at least one seal of said triangular fabric inner segment bags including an inner seal and an outer seal.

4. The weightlifting plate of claim 3, further comprising:

at least one fabric handle attached to said circular fabric edge panel of said circular fabric outer housing bag;

a closeable opening formed in said circular fabric edge panel;

a zipper affixed to the edges of said closeable opening; and a cover flap affixed on said circular fabric edge panel that extends over said zipper.

5. The weightlifting plate of claim 4, further comprising:

a colored fabric strip with a first portion hook and loop fastener strip affixed thereon; and a second portion hook and loop fastener strip meshingly engageable with said first portion hook and loop fastener strip, affixed to said cover flap.

6. The weightlifting plate of claim 4, further comprising:

a generally triangular top face on said triangular fabric inner segment bags with a slit cut there across said triangular top face;

a lower hook and loop fastener strip having a first width, placed adjacent a lower edge of said slit;

a first upper hook and loop fastener strip having a second width, placed adjacent an upper edge of said slit in an overlaying fashion such that when meshingly engaged with said lower hook and loop fastener strip, seals closed said slit;

an outer flap extending from said top face of said inner segment bags, said flap having a second upper hook and loop fastener strip of a third width thereon, that meshingly engages with said lower hook and loop fastener strip adjacent to said first hook and loop fastener strip, and positions said flap over said slit.

7. The weightlifting plate of claim 2, wherein said at least one seal of said triangular fabric inner segment bags including an inner seal, and intermediary seal, and an outer seal.

8. The weightlifting plate of claim 7, wherein said triangular fabric inner segment bags have two triangular panels joined by a side edge strip, said side edge strip having a slit formed therethrough.

9. The weightlifting plate of claim 8, further comprising:

an inner media sleeve within said triangular fabric inner segment bag that extends through said slit, said inner media sleeve having an openable top end;

a first pair of opposing and engageable hook and loop fastener strips located inside a top edge of a top end of said inner media sleeve;

a second pair of engageable hook and loop fastener strips that reside adjacent each other on an outer face of said inner media sleeve; and a third pair of engageable hook and loop fastener strips affixed on opposable sides of said slit.

10. The weightlifting plate of claim 1, wherein said rigid cylindrical bar collar has a securement tab extending therefrom a center that extends through an opening cut into the center of said fabric collar tunnel.

* * * * *